United States Patent [19]

Carr

[11] Patent Number: 4,754,556

[45] Date of Patent: Jul. 5, 1988

[54] FRONT BULKHEAD MOUNTING FOR A DRYER

[75] Inventor: Keith E. Carr, Lincoln Township, Berrien County, Mich.

[73] Assignee: Whirlpool Corporation, Benton Harbor, Mich.

[21] Appl. No.: 897,303

[22] Filed: Aug. 18, 1986

[51] Int. Cl.[4] ..... F26B 11/04

[52] U.S. Cl. ..... 34/133

[58] Field of Search ..... 34/33, 133; 29/281.5, 29/469; 160/217, 218, 220; 49/400, 401, 397, 463

[56] References Cited

U.S. PATENT DOCUMENTS

| | | | |
|---|---|---|---|
| 2,722,272 | 11/1955 | Sprinkle | 49/463 |
| 2,858,688 | 11/1958 | Smith | 34/133 |
| 3,167,409 | 1/1965 | Brucken | 34/133 |
| 3,584,393 | 6/1971 | Menk | 34/88 |
| 3,789,514 | 2/1974 | Faust | 34/133 |
| 3,792,551 | 2/1974 | Hallas | 49/463 |
| 4,130,966 | 12/1973 | Kujawa et al. | 49/401 |
| 4,422,688 | 12/1983 | Kameoka | 49/397 |
| 4,430,809 | 2/1984 | Jackson | 34/133 |
| 4,483,102 | 11/1984 | Edwards | 49/397 |
| 4,516,335 | 5/1985 | Aoki et al. | 34/133 |
| 4,586,269 | 5/1986 | St Louis | 34/133 |

*Primary Examiner*—Larry I. Schwartz

*Attorney, Agent, or Firm*—Hill, Van Santen, Steadman & Simpson

[57] ABSTRACT

A mounting arrangement for a front bulkhead to a front cabinet is provided for a clothes dryer in which the front bulkhead and the front cabinet panel have overlying access openings therein and cooperating tab and groove elements provide a hinge connection along one side of the openings and threaded fasteners provide a positive attachment along an opposite side of the opening. The fasteners are accessible from the front of the dryer thus assisting in permitting front serviceability for the dryer.

20 Claims, 2 Drawing Sheets

FRONT BULKHEAD MOUNTING FOR A DRYER

BACKGROUND OF THE INVENTION

1. Field of the Invention

The present invention relates to clothes dryers and more particularly to a means for mounting a stationary front bulkhead for a clothes dryer drum on the cabinet front panel.

2. Description of the Prior Art

In horizontal axis drum dryers there generally is a stationary front wall which carries a seal member to provide an essentially air tight seal between the rotating drum and the stationary front wall. The stationary front wall is generally interposed between the rotating drum and a front panel of the dryer cabinet.

In U.S. Pat. No. 3,584,393 an interfitting three-part stationary front collar portion 24 is secured through ported bosses 23 to the dryer front wall 10 by means of screws. It appears that the front collar 24 would have to be secured to the front wall 10 either prior to assembling the front wall to the cabinet or prior to assembling the rear wall to the cabinet in that the screws could not be reached with the cabinet assembled.

U.S. Pat. No. 4,430,809 discloses a stationary ring 44 which is attached to a front panel 14 of the cabinet in that a small flanged portion 64 from the front panel 14 is crimped over a lip portion 66 of the support ring 44.

SUMMARY OF THE INVENTION

The present invention provides an improved mounting arrangement for a stationary front bulkhead to the cabinet front panel in a clothes dryer. An access opening in the cabinet front wall has a return hook along its top side and a rolled flange around the other sides. The stationary front bulkhead has a tab along a top side of an access opening that engage in the hook of the cabinet front opening. The two parts are brought together with a seal gasket in between. Holes are provided below the lower corners of the access openings for insertion of retaining screws from the front side of the cabinet front panel. The threads of the screws that extend into the clothes tumbling area are covered by a plastic air outlet grill which is part of the assembly.

This structural arrangement permits the stationary front bulkhead and the cabinet front to be finished with different processes and then assembled. This manufacturing flexibility is not available when the two pieces are held together by a crimp since a further finishing step of the assembly must be provided after a mechanical crimp has been made. Further, since the screws which hold the parts together are accessible from the front of the dryer embodying the present invention, disassembly of the dryer cabinet from the rear is not required for servicing of the parts.

DESCRIPTION OF THE PREFERRED EMBODIMENTS

Figure 1:
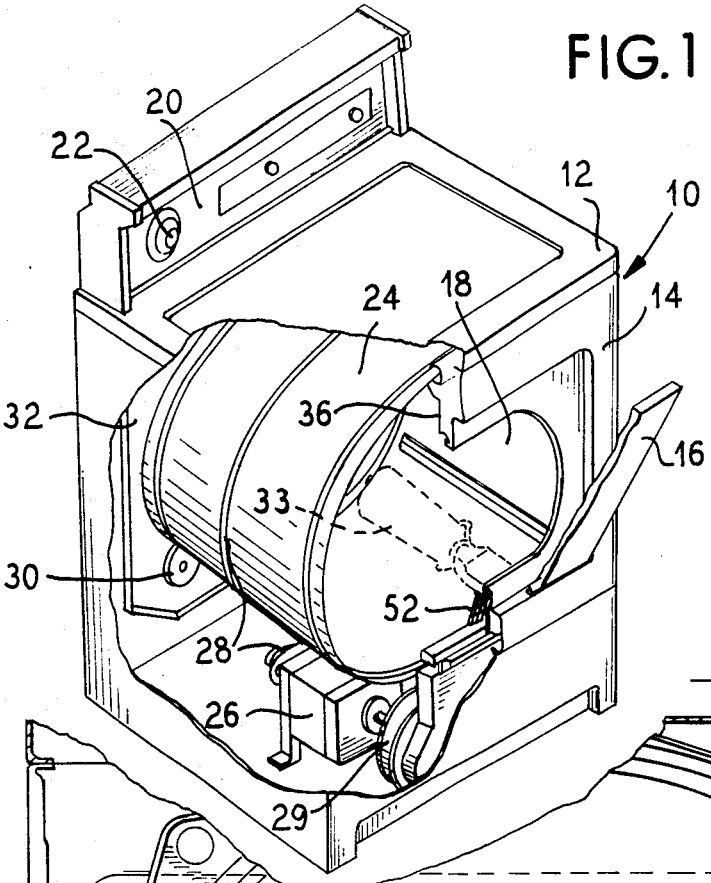
FIG. 1 is a perspective view of a dryer, partially cut away to show the structure embodying the principles of the present invention.

In FIG. 1 there is illustrated a horizontal axis clothes dryer 10 embodying the principles of the present invention. The dryer is comprised of a cabinet 12 having a front panel 14 with an openable door 16 revealing an access opening 18. A console 20 having presettable controls 22 thereon allows an operator to preselect a program of automatic drying and tumbling in a laundry drying process. The door 16 in the front panel 14 of the cabinet 12 permits access through the access opening 18 into the interior of a drum 24 having open ends which is rotatably mounted within the cabinet 12.

Figure 2:
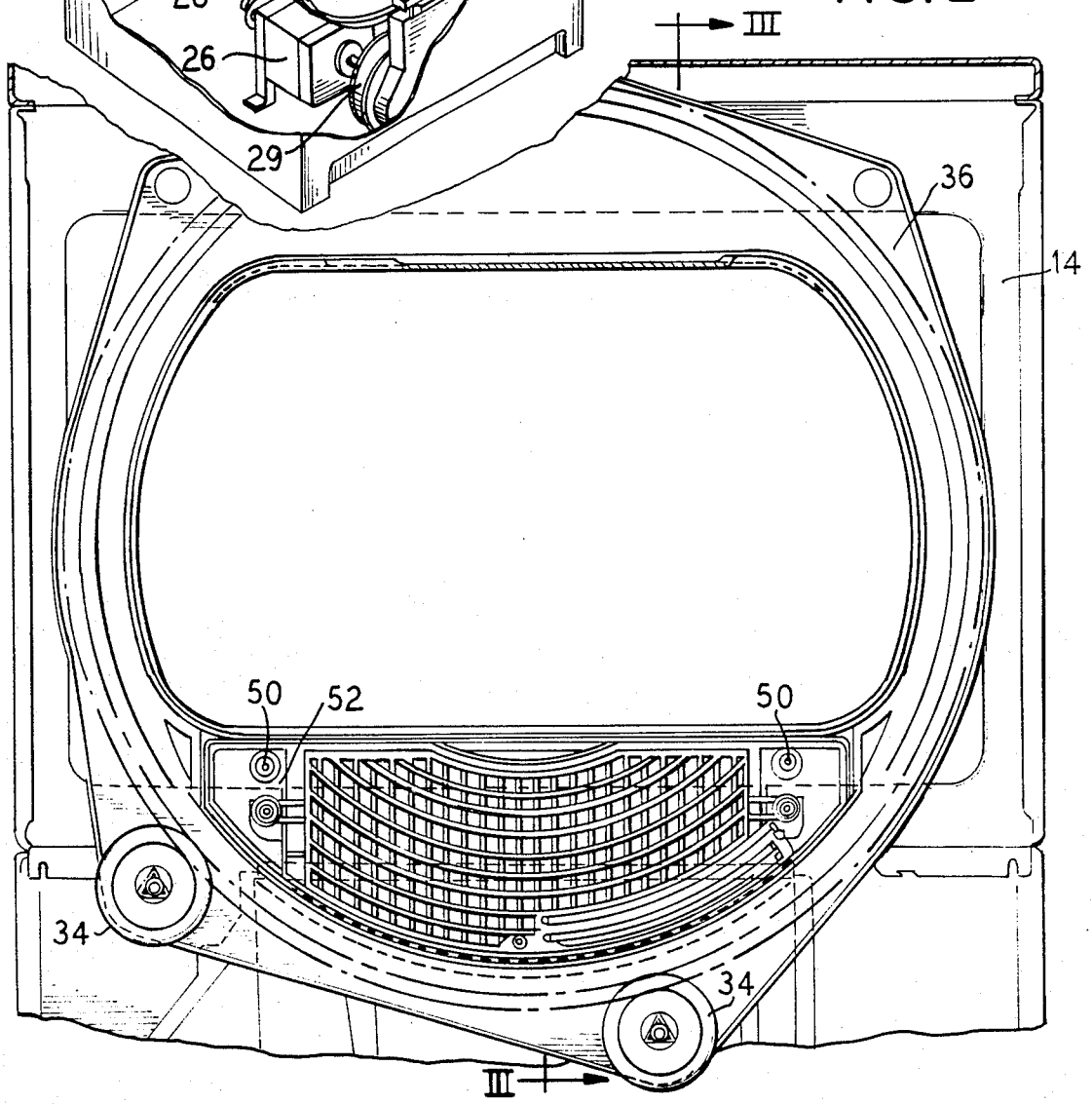
FIG. 2 is a view of the dryer stationary front bulkhead and front panel taken from the interior of the drum.
Figure 3:
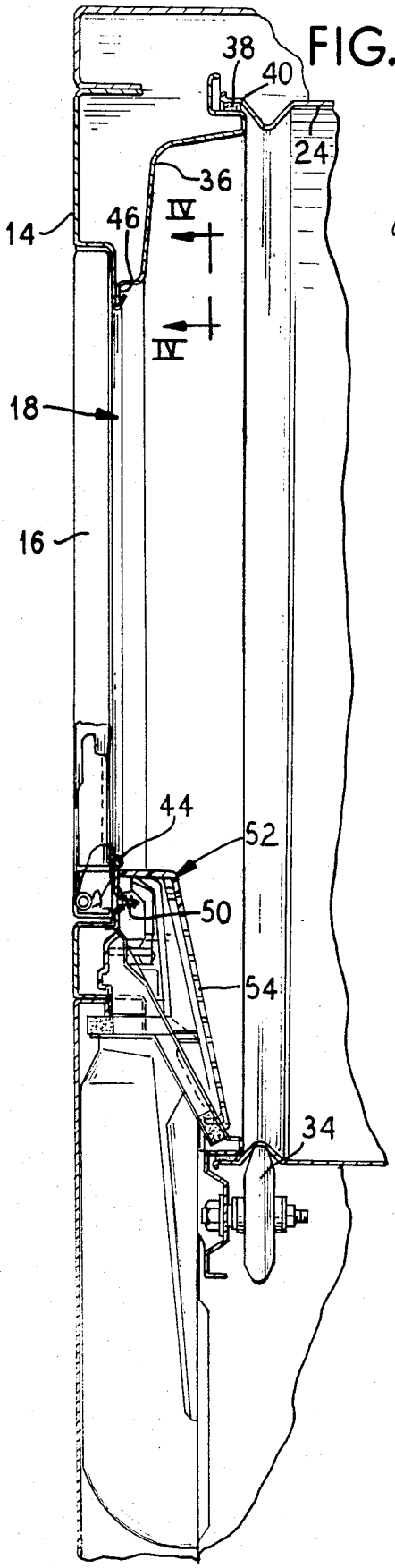
FIG. 3 is a sectional view of the front assembly of the dryer taken generally along the line III—III of FIG. 2.
Figure 4:
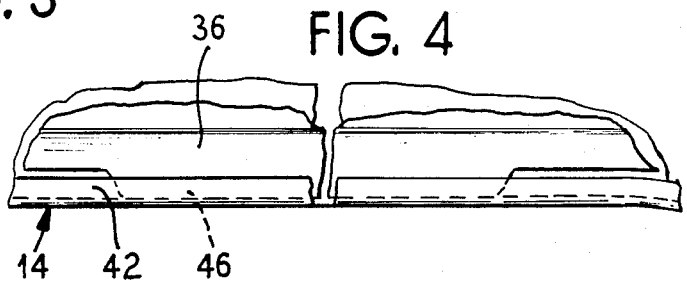
FIG. 4 is a partial elevational view of the tab and hook connection between the stationary front bulkhead and the cabinet front panel taken generally along the line IV—IV of FIG. 3.
Figure 5:
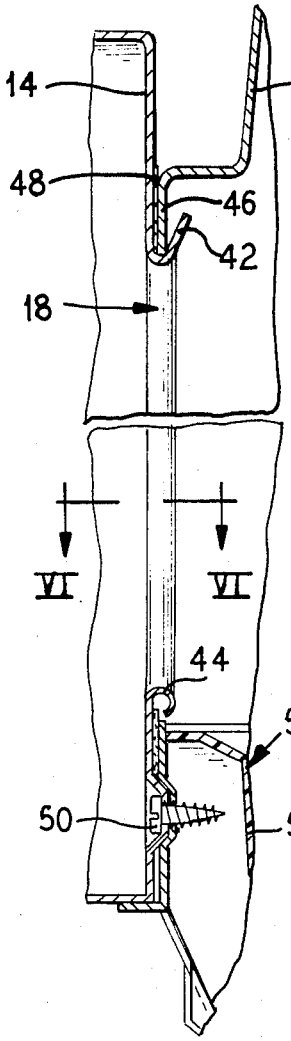
FIG. 5 is a partial enlarged view of the section shown in FIG. 3.
Figure 6:
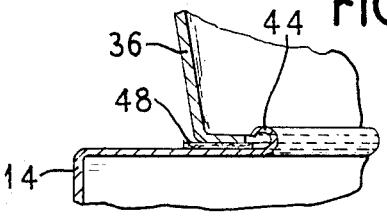
FIG. 6 is a sectional view of the edge connection between the stationary drum front and the cabinet front panel taken generally along the line VI—VI of FIG. 5.

Below the drum 24 but within the cabinet 12 there is provided an electric motor 26 which rotatably drives the drum by means of a belt 28 and also drives a blower 29. A stationary back wall 32 is provided which has inlet openings (not shown) within the drum for the passage of air circulated by the blower 29 which is used in the drying process. A heater 33 conditions the air before it enters the drum through the inlet openings. The stationary back wall also has mounted thereon two rollers 30 (only one shown) which support the rear portion of the drum 24. A front portion of the drum is supported by rollers 34 (FIGS. 2 and 3). A stationary drum front or front bulkhead 36 is provided between the dryer front panel 14 and the rotating drum 24.

In FIG. 3 it is seen that there is provided a seal member 38 between the stationary drum front 36 and a front edge 40 of the rotating drum 24. This seal provides a relatively air tight connection between the rotating drum 24 and the stationary drum front 36.

The stationary drum front 36 and its mounting attachment to the front panel 14 is illustrated in greater detail in FIGS. 2-6.

The access opening 18 through the front of the dryer is defined by an opening in the cabinet front panel 14 as well as an opening in the stationary drum front 36. The opening in the cabinet front panel 14 has a return hook 42 along its top side and a rolled flange 44 around the other sides. The return hook 42 comprises a laterally elongated, V-groove shaped member extending most of the distance across the top of the dryer access opening 18, in which the V-shape opens upwardly.

The stationary dryer front 36 has a tab 46 that engages in the hook 42 to provide a positive locating function between the stationary front 36 and the front panel 14. The tab 46 comprises a laterally elongated member projecting downwardly which, when received in the V-shaped return hook 42 acts as an open hinge or pivot so long as the front panel 14 is held upwardly relative to the stationary drum front 36. Such a construction permits the lower edge of the front panel 14 to pivot toward or away from the stationary drum front 36 when the tab 46 and hook 42, are engaged. The rolled flange 44 around the remaining sides of the opening in the cabinet front panel 14 provides a smooth and finished edge for the access opening 18.

A seal gasket 48 is provided between the stationary front 36 and the front panel 14. The front panel 14 is removably held onto the stationary drum front 36 by means of a pair of threaded fasteners 50 positioned beneath the access opening 18, near either lateral side thereof. The threaded fasteners extend from the front panel 14 through the stationary drum front 36. That is, the fasteners are installed from the front of the front panel and are always accessible from that location even after complete assembly of the dryer. The fasteners are concealed from view by the access door 16. A plastic air outlet grill 52 is mounted on the interior of the stationary drum front 36 and has a wall portion 54 which is spaced away from the stationary drum front 36. The threads of the fasteners 50 which extend into the clothes tumbling area within the rotating drum 24 are covered by the plastic air outlet grill 52 and are thus shielded from the drum interior.

It should be realized that it is within the scope of my invention to provide cooperating tab and groove elements located along an overlying portion of the access openings in the front cabinet panel 14 and the bulkhead 36, whether that portion be at the top, bottom or lateral side of the openings. Further, although a single tab and a single groove element are illustrated as an exemplary embodiment of the invention, multiple tab and groove elements could be provided and the tabs may all be on one front member while the grooves are all on the other front member, or their placement may be mixed. Also, other types of securing means than threaded fasteners may be utilized, but the securing means should be positioned across the access openings from the tab and groove elements. The securing means are preferably accessible from the front side of the front panel 14.

Thus, to assemble the front panel onto the stationary drum front, the front panel opening is guided toward and aligned with the stationary drum front opening and the hook portion 42 is engaged with the tab portion 46 with the seal gasket 48 held therebetween. Then, the bottom portion of the front panel 14 is pivoted toward the stationary drum front to permit the threaded fasteners 50 to be inserted through the front panel and the stationary drum front.

It will be appreciated that such an assembly procedure allows for the stationary drum front and the cabinet front to be finished with different processes and then assembled. Further, it will be appreciated that the front panel can be assembled to and removed from the stationary drum front from the front of the dryer without requiring an assembler or a repair man to have access to the interior of the cabinet. Thus, such an attachment arrangement provides a measure of front serviceability to the dryer assembly. That is, the service man or home owner is not required to disassemble the dryer from the rear or even to have access to the rear of the dryer in order to remove the cabinet front panel.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. In a dryer having a drum rotating about a horizontal axis, a front cabinet panel with an access opening therein and a stationary front bulkhead with an access opening therein positioned between said drum and said front panel, so that said access openings are in alignment, a mounting arrangement comprising:

essentially radially directed cooperating tab and groove elements located along an overlying portion of said access openings in said front cabinet panel and said stationary front bulkhead providing a pivotal connection between said cabinet panel and said bulkhead; and securing means between said front cabinet panel and said stationary front bulkhead across said openings from said tab and groove elements;

whereby, said stationary front bulkhead and said front cabinet panel can be pivotally engaged at said cooperating tab and groove elements and can be secured together by said securing means.

2. A mounting arrangement according to claim 1, wherein at least one tab element is provided on one of said front cabinet panel and said stationary front bulkhead and at least one groove element is provided on the other of said front cabinet panel and said stationary front bulkhead.

3. A mounting arrangement according to claim 2, wherein a single tab element is provided on said stationary front bulkhead and a single groove element is provided on said front cabinet panel.

4. A mounting arrangement according to claim 1, wherein said tab and groove elements are positioned along an upper edge of said access openings and said securing means are positioned adjacent to a lower edge of said access openings.

5. A mounting arrangement according to claim 1, wherein said securing means are accessible from a front side of said front panel.

6. A mounting arrangement according to claim 1, wherein said securing means comprise threaded fasteners.

7. A method of assembling a front panel to a stationary drum front in a horizontal axis clothes dryer comprising the steps:

guiding said front panel toward said stationary drum front such that access openings in said front panel and drum front will be in alignment;

radially engaging a top edge of each access opening with the other to position said front panel relative to said front wall;

pivoting said front panel toward said drum front while holding said top edges in engagement; and securing said front panel to said drum front beneath said access openings.

8. A method according to claim 7, wherein said step of securing is done by engaging threaded fasteners between said front panel and said drum front.

9. A method according to claim 8, wherein said threaded fasteners are inserted from said front panel into said drum front.

10. A method according to claim 7 including a further step of positioning a seal gasket member between said front panel and said drum front.

11. In a dryer having a drum rotating about a horizontal axis, a front cabinet panel with an access opening therein and a stationary drum front with an access opening therein positioned between said drum and said front panel so that said access openngs are in alignment, an attachment arrangement between said stationary drum front and said front panel comprising:

a radially outwardly opening hook portion formed along a top edge of said access opening in said front panel;

a radially inwardly directed tab portion formed along a top edge of said access opening in said stationary drum front pivotally engageable with said hook portion; and fastening members below said access openings to secure said front panel to said stationary drum front;

whereby, said tab and hook engagement will position said front panel and stationary front relative to one another.

12. An attachment arrangement according to claim 11, wherein said hook portion comprises a laterally elongated, V-shaped member and said tab portion comprises a laterally elongated member such that said pivoting engagement is formed between said hook portion and said tab portion.

13. An attachment arrangement according to claim 11, wherein said fastening members are accessible from a front side of said front cabinet panel.

14. An attachment arrangement according to claim 11, wherein said fastening members comprise theaded fasteners extending through said front panel and said stationary front.

15. In a dryer having a drum rotating about a horizontal axis, a front cabinet panel with an access opening therein and a stationary drum front with an access opening therein positioned between said drum and said front panel so that said access openings are in alignment, an attachment arrangement between said stationary drum front and said front panel comprising:

a radially outwardly opening hook portion formed along a top edge of said access opening in said front panel;

a radially inwardly directed tab portion formed along a top edge of said access opening in said stationary drum front pivotally engagable with said hook portion; and fastening members comprising threaded fasteners extending through said front panel and said stationary front below said access openings to secure said front panel to said stationary drum front;

said stationary front including an air outlet grill attached to a lower interior surface thereof into which said fastening members extend such that they are shielded from an interior of said rotating drum;

whereby, said tab and hook engagement will position said front panel and stationary front relative to one another.

16. An attachment arrangement according to claim 11 including a seal gasket member positionable between said front panel and said stationary front around said access openings.

17. An attachment arrangement according to claim 15 including a seal gasket member positionable between said front panel and said stationary front around said access openings.

18. An attachment arrangement according to claim 15, wherein said fastening members are accessible from a front side of said front cabinet panel.

19. An attachment arrangement according to claim 15, wherein said hook portion comprises a laterally elongated, V-shaped member and said tab portion comprises a laterally elongated member such that a pivoting engagement is formed between said hook portion and said tab portion.

20. An attachment arrangement according to claim 15, wherein a single tab element forms said tab portion and a single hook element forms said hook portion.

* * * * *